US006296462B1

(12) United States Patent
Driver et al.

(10) Patent No.: US 6,296,462 B1
(45) Date of Patent: Oct. 2, 2001

(54) ROTARY POSITIVE-DISPLACEMENT FLUID MACHINES

(75) Inventors: Ronald William Driver, Lancashire; David Peter Davidson, Leicestershire, both of (GB)

(73) Assignee: Driver Technology Limited, Leicestershire (GB)

( * ) Notice: Subject to any disclaimer, the term of this patent is extended or adjusted under 35 U.S.C. 154(b) by 0 days.

(21) Appl. No.: 09/445,725

(22) PCT Filed: Jun. 10, 1998

(86) PCT No.: PCT/GB98/01694

§ 371 Date: Feb. 3, 2000

§ 102(e) Date: Feb. 3, 2000

(87) PCT Pub. No.: WO98/57039

PCT Pub. Date: Dec. 17, 1998

(30) Foreign Application Priority Data

Jun. 11, 1997 (GB) ..... 9711979
Sep. 30, 1997 (GB) ..... 9720691

(51) Int. Cl.[7] ..... F01C 1/44
(52) U.S. Cl. ..... 418/265
(58) Field of Search ..... 418/265

(56) References Cited

U.S. PATENT DOCUMENTS 147,623 * 2/1874 Ellis ..... 418/265
4,149,833 * 4/1979 Baudin ..... 418/265

FOREIGN PATENT DOCUMENTS

2161693 * 6/1973 (DE) .
2233145 * 1/1974 (DE) .
0248613 * 12/1987 (EP) .
2010401 * 6/1979 (GB) .
2014244 * 8/1979 (GB) .
96/39571 * 12/1996 (WO) .

* cited by examiner

*Primary Examiner*—John J. Vrablik
(74) *Attorney, Agent, or Firm*—Morgan, Lewis & Bockius LLP

(57) ABSTRACT

A rotary positive-displacement fluid machine comprising a rotor eccentrically mounted in a casing for rotation about an axis, the rotor having recesses respectively receiving vanes which oscillate in the recesses as the rotor rotates. Each vane is connected by a crank to an arm for oscillation about a vane axis which is located inwards of the outer extremity of the tip which itself has a clearance fit within the casing. The tip of each vane is preferably curved about an axis parallel to the respective vane axis. The machine may be connected to the crankshaft of an internal combustion engine and driven by the pressure difference between the ambient air and that at the engine inlet manifold. Alternatively, the device may be operated as a heat pump.

14 Claims, 6 Drawing Sheets

ROTARY POSITIVE-DISPLACEMENT FLUID MACHINES

THIS INVENTION relates to rotary positive-displacement fluid machines.

Such as machine is described in patent specification WO 96/39571 in which a rotor is eccentrically mounted in a casing for rotation about an axis the rotor having recesses respectively receiving vanes which oscillate in the recesses as the rotor rotates, each vane being connected by a crank to an arm for oscillation thereon about a vane axis, which arm can oscillate about an axis offset from the rotor axis. The vane axis coincides with the radial inner surface of the casing thus to pivot about the vane tip on a axis which coincides with the radial inner surface of the casing.

According to the present invention there is provided a rotary positive-displacement fluid machine comprising a rotor eccentrically mounted in a casing for rotation about an axis, the rotor having recesses respectively receiving vanes which oscillate in the recesses as the rotor rotates, each vane being connected by a crank to an arm for oscillation thereon about a vane axis, which arm can oscillate about an axis offset from the rotor axis, characterised in that the vane axis is located radially inwards of the radial inner surface of the casing.

The vane tip may be curved about said vane axis. The profile of the curved tip of each vane may be modified to a more flattened shape to ensure clearance from the radial inner surface of the casing at high rotor speeds. The modified profile may comprise one or more flats.

The invention may be performed in various ways and one specific embodiment with possible modifications will now be described by way of example with reference to the accompanying drawings, somewhat diagrammatic, in which.

Figure 1:
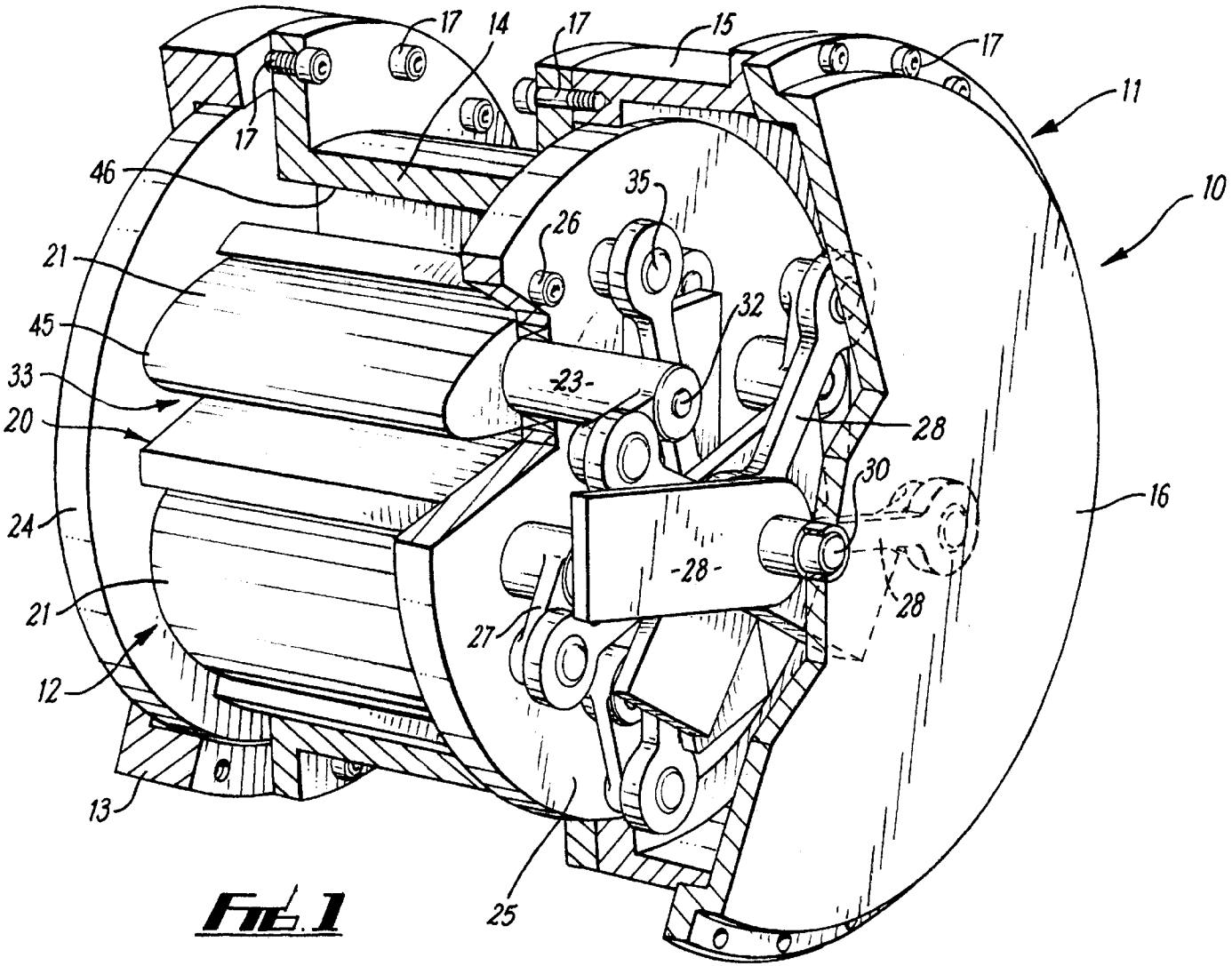
FIG. 1 is a perspective view part cut away of a rotary machine.

A rotary positive-displacement fluid machine 10 has an outer stator assembly 11 within which can rotate an eccentrically mounted rotor assembly 12. The stator assembly 11 has a first end plate 13, a two-part radially stepped casing part 14, 15 and a second end plate 16, the assembly being held together by bolts 17, with fluid-tight seals as appropriate (not shown), and providing an expansion/compression chamber 70.

The rotor assembly 12 comprises a rotor 20 with angularly spaced peripheral recesses 33 receiving respective vanes 21. Each vane 21 is integral with end shafts 22, 23 mounted respectively for rotation (oscillation) about axis 32 on bearings 24*a*, 25*a* in a first rotor disc 24 and a second rotor disc 25 secured to the rotor 20 by bolts 26 (only one shown). The shafts 23 are pivotally connected by respective integral crank arms 27 to oscillating arms or spokes 28 which can oscillate (about an axis 30) on a common shaft 29 which is fixed in the second end plate 16.

The arms 28 rotate with the rotor and also oscillate on the shaft 29. The arms 27 oscillate about axes 35.

A drive shaft 40 with an axis 41 offset from the axis 30 is held by bolts 26 to the rotor assembly.

With this arrangement, the vanes 21 oscillate about axes 32 in the recesses 33 to produce a compression region 43 and an expansion region 44 with the outer surface 45 of the vanes 21 disposed with very small clearance with respect to the inner surface 46 of the casing 14.

The vane surfaces 45 are machined to maximum tolerance and the vane surface has a very small running clearance with surface 46.

Suitable bearings 50 are provided as required.

In the present case the rotor assembly 12 is supported on the drive shaft 40.

The end wall 13 is extended axially at 51 its central region towards the end wall 16 with interposed bearings 52, 53. The pressure load on the rotor assembly is thus largely taken on bearings 52, 53 so as to be axially distributed rather than being cantilevered at an end of the drive shaft.

The drive shaft 40 is received at 42 in the shaft 29 which improves balance and the shaft 29 is thus supported at both its ends and has less bending load than a cantilevered shaft and can thus be smaller, reducing weight. The shaft 29 can be integral with plate 16. The shafts 29, 40 can be assembled by relative axial movement.

This feature can be used in machines with vanes which slide radially in and out in the rotor.

In the present case the axes 35 of relative angular movement between the arms 27 and 28 are radially inwards of the casing surface 46 and of the outer surfaces or tips 45 of the vanes, which are curved about or around the axes 35 (part-circular).

Compared with an arrangement in which the axis 35 is coincident with the surface 46 and the surface 45 is effectively an edge about which the vane 21 pivots as it rotates in the casing, the present arrangement provides a curved surface for the vane tip which rolls as the vane is oscillated about axis 35 thus reducing tip wear. The curved vane tip is easier to make, is stronger, and improves maintenance of tip clearance. The lengths of arms 27 and 28 are also less thus reducing weight and providing for a smaller overall machine diameter.

Figure 4:
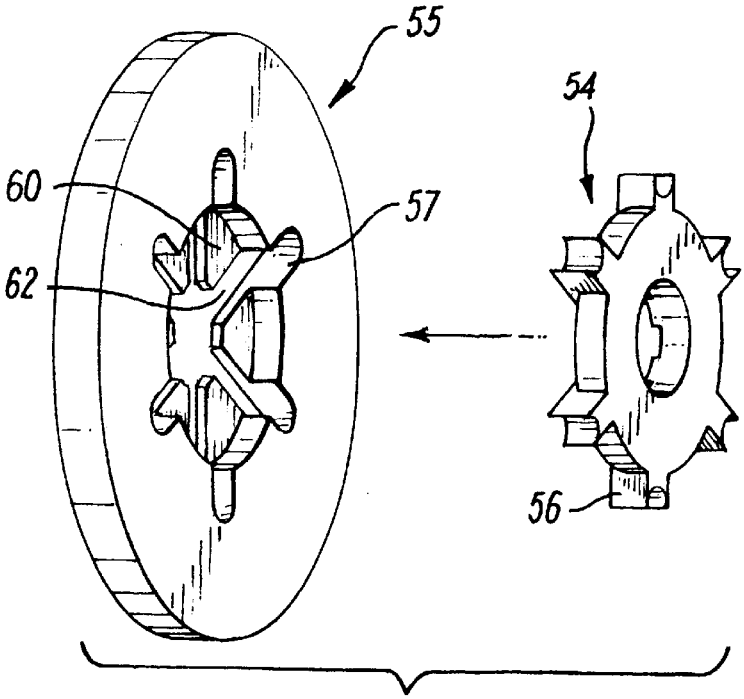
FIG. 4 is an exploded perspective view of a rotor disc.
Figure 5:
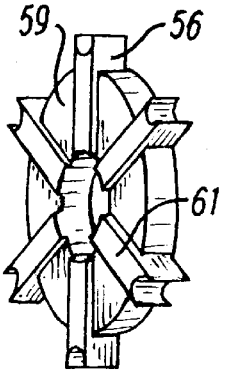
FIG. 5 is a perspective view of part of the disc.

For ease of manufacture and assembly the rotor disc 25 is formed from two parts 54, 55 FIG. 4 which are assembled by relative axial movement. The part 54 has radial portions 56 with concave ends which are received in radial recesses 57 in part 55 to form apertures 58 for the shafts 23 and have recesses 59 in one face which receive projections 60 of part 55 with ribs 61 received in slot 62 between projections 60, the whole providing aperture 63 for rotor portion 20a. The shafts 23 are placed in apertures 58 in part 55 before the part 54 is moved axially into position. In this case the rotor surf ace 20*b* FIG. 2 can extend the axial extent of disc 25. If the rotor is cut away to provide flange 64 the part 55 has an end recess for receipt of flange 64 on shaft 40.

Rotor disc 24 can be made as two pieces formed by a circular split line passing through apertures in disc 24 for receiving shafts 22 and assembled by relative axial movement.

Figure 7:
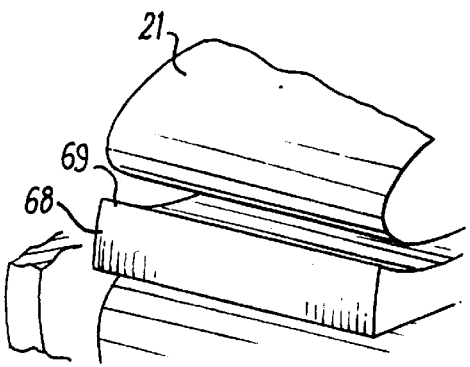
FIG. 7 shows a modification.
Figure 3:
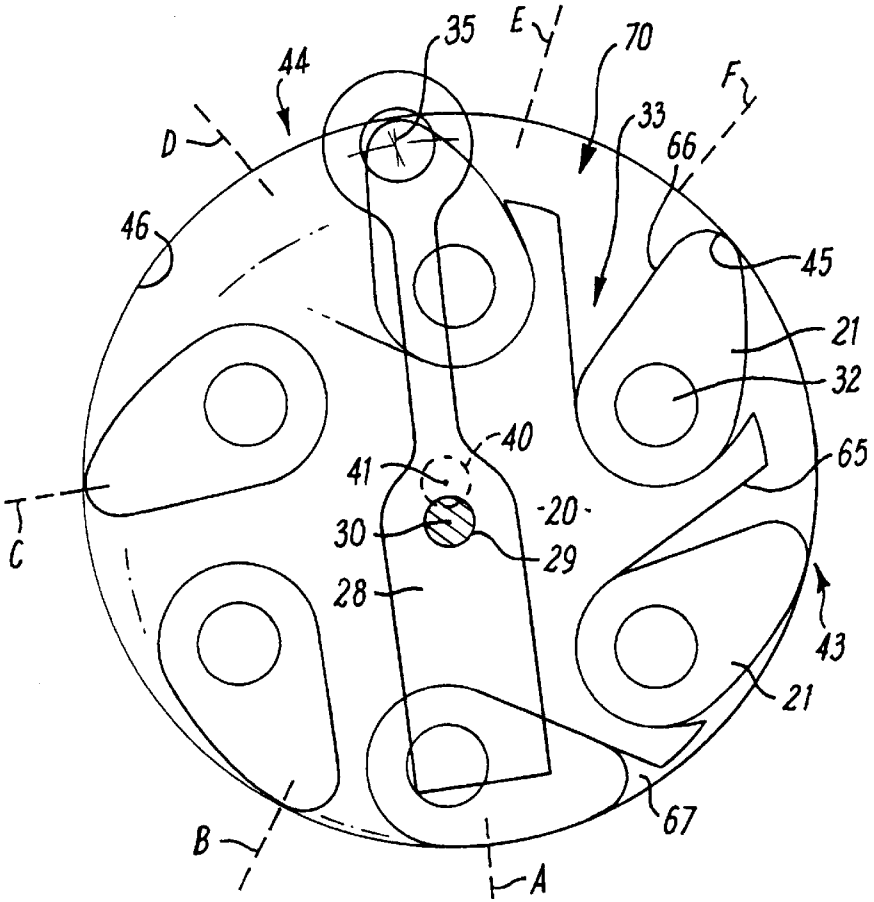
FIG. 3 is a schematic axial view of a rotor.

One wall surface 65 (the trailing surface) of the recess 33 generally conforms to a surface 66 of the respective vane 21 and the curved surface 45 means that at one limit of the oscillating movement of the vane 21 there will be a small volume 67 FIG. 3 not occupied by the vane. As shown in FIG. 7 this can be reduced by appropriately shaping the rotor portion 68 at 69. This reduces loss of compression.

Figure 8:
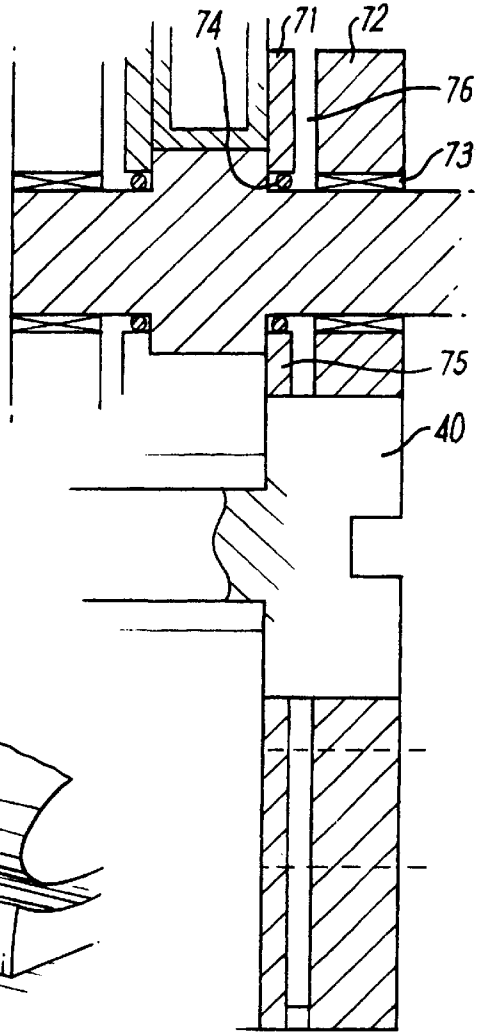
FIG. 8 shows another modification.
Figure 6:
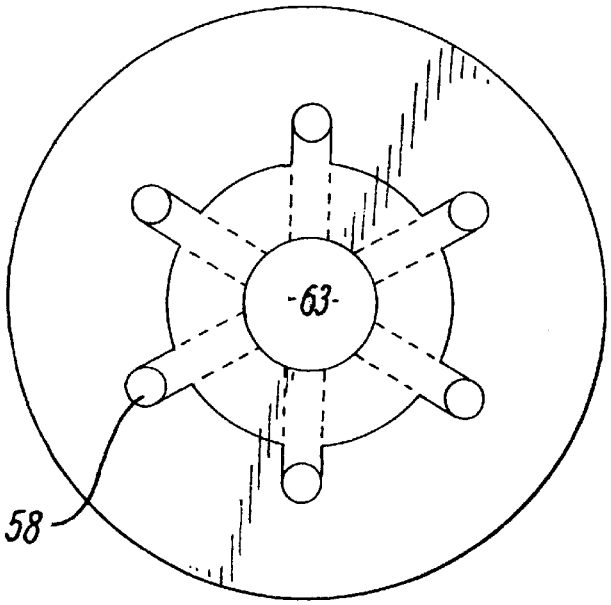
FIG. 6 is an axial view of the disc.

As shown in FIG. 8, one way of sealing the expansion/compression chamber 70 against entry of lubricating oil is to split the discs 24, 25 into two axially spaced parts 71, 72 bolted together at their radial outer ends and provide bearing 73 for part 72 and seal 74 for part 71 engaging a ring 75 on the shaft 40. The gap 76 between parts 71, 72 can act as an air vent and oil drain. In this case the parts 71, 72 can each be in two parts connected by a circular face passing through apertures 58, and the arrangement of FIG. 6 is not needed.

Figure 2:
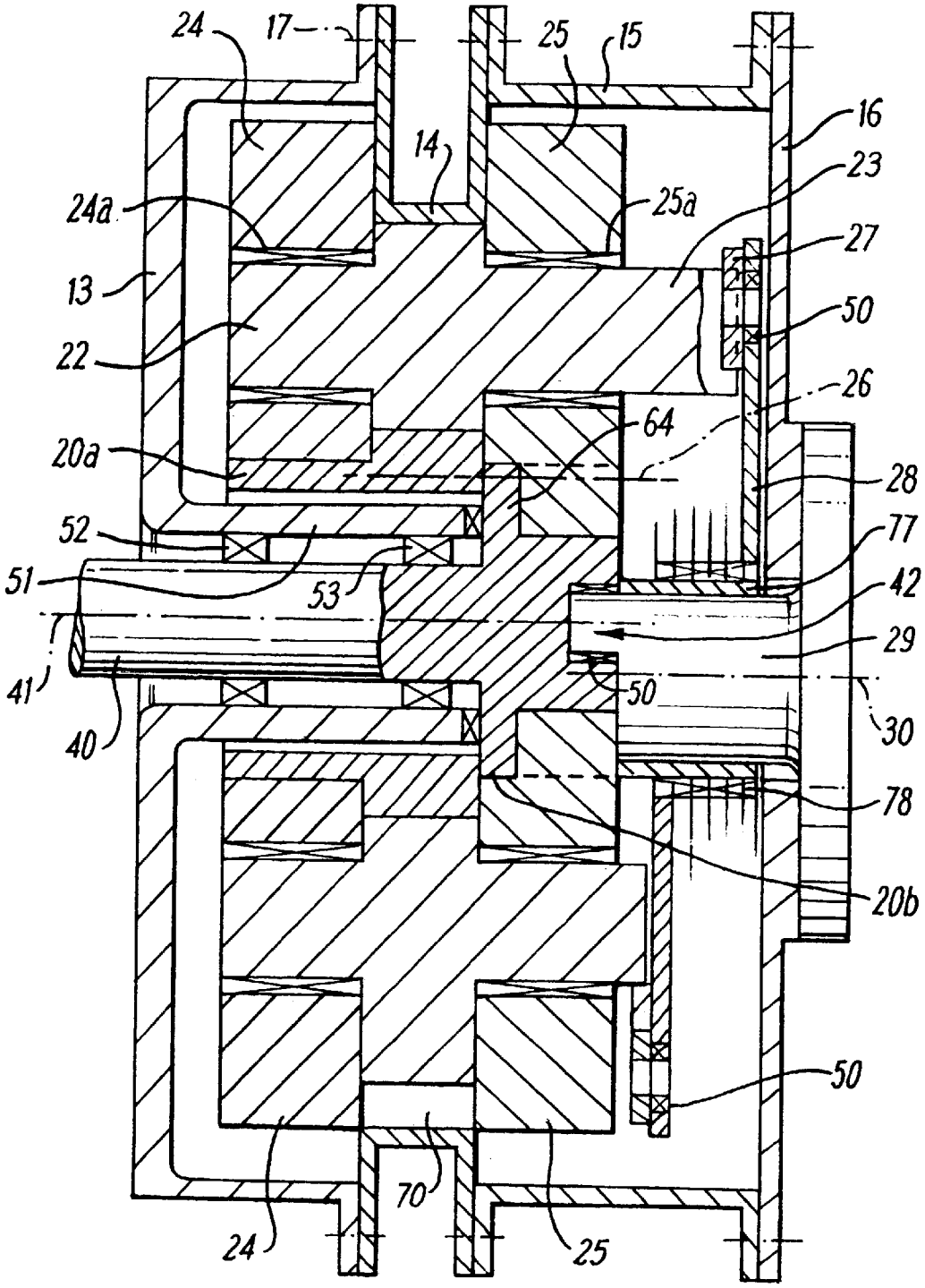
FIG. 2 is a schematic section of a machine.

A close sleeve 77 FIG. 2 can be located on shaft 29 between part 16 and disc 25 and the arms 28 can oscillate on the sleeve 77 with interposed bearings 78. This distributes the radial loading along the sleeve (the radial loading on arms 28 varies as they rotate). The sleeve 77 rotates at a speed between the rotor speed and the oscillation speed of the arms 28.

Figure 9:
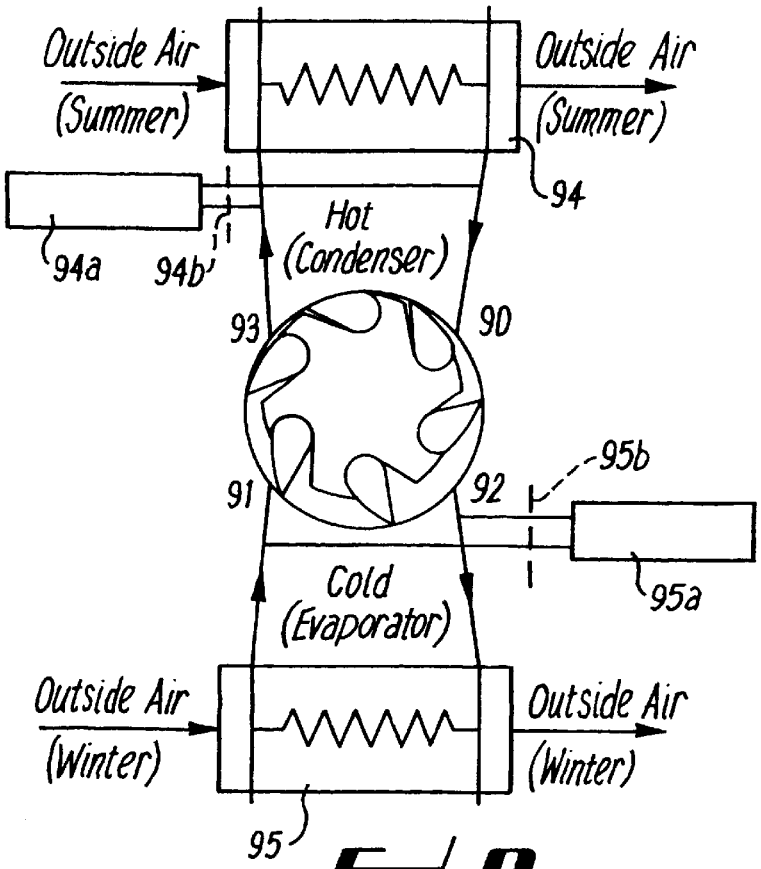
FIG. 9 illustrates a heat pump.

In one example, FIG. 9, the device is used as a heat pump. Angularly spaced inlet ports 90, 91 and outlet ports 92, 93 communicate with the interior 70 of the casing. Radiators 94 and 94*a* are selectively connectable by switching 94*b* to ports 90, 93; and radiators 95, 95*a* are selectively connectable by switching 95*b* to ports 91, 92. Fluid is circulated in a closed circuit. Radiators 94*a* and 95*a* are inside the house and radiators 94, 95 are outside the house.

In summer, radiators 94*a*, 95 are not used. Hot fluid leaving port 93 is cooled in radiator 94 by outside air and further cooled fluid leaving port 92 cools radiator 95*a*.

In winter radiators 94 and 95*a* are not used; cold air leaving port 92 is heated in radiator 95 by outside (less cold) ambient air, and the heated fluid from port 93 heats the house via radiator 94*a*.

If the device is used for example as a throttle loss recovery turbine in an internal combustion engine 131 (FIGS. 10 and 12) the device 100 replaces a butterfly valve between the air intake 120 and the inlet manifold 102, being driven by the pressure difference between ambient and the inlet manifold which is at a pressure less than ambient and thus driving belt 103 and crankshaft pulleys 104 to put energy into the crankshaft.

Figure 10:
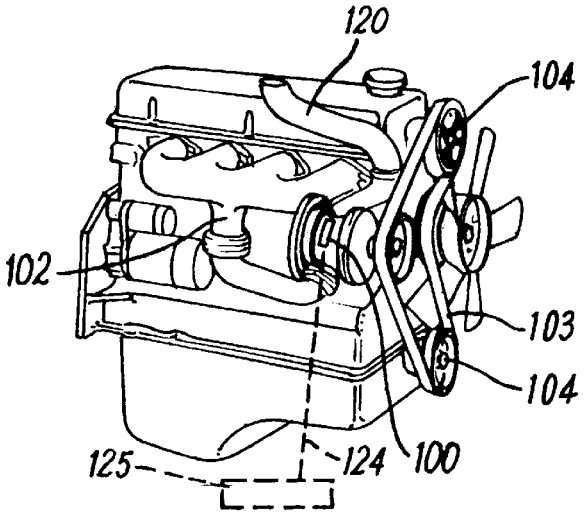
FIG. 10 shows an engine.
Figure 11:
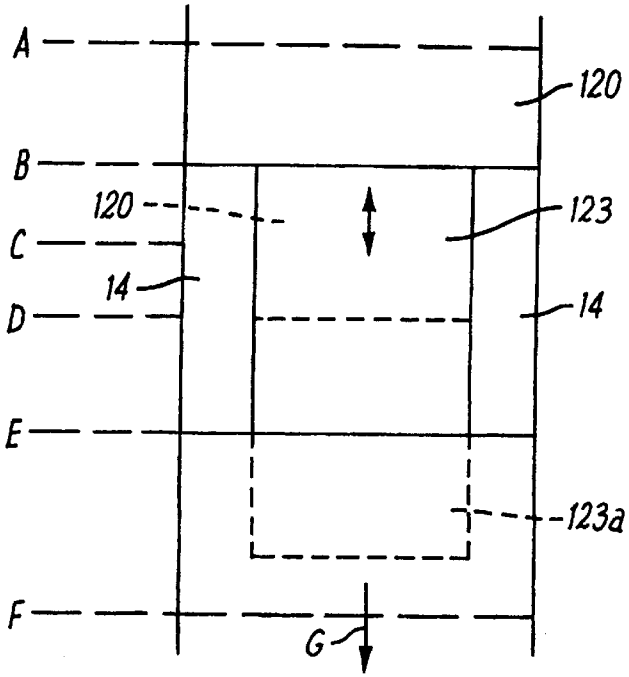
FIG. 11 shows a control plate.

In this case, as rotor speed increases, the fluid mass flow is increased. For example as shown in FIGS. 3 and 11, an angularly extending air inlet port 120 is formed in casing 14, and angularly slidable in the casing to enlarge or reduce the angular extent of the inlet port is a plate 123 which can move from its position illustrated with full lines in FIG. 11, at idling speed to a position 123*a* illustrated with dotted lines at maximum rotor speed (full throttle). At idling speed the air inlet port 120 extends from A to B in FIGS. 3 and 11, but plate 123 moves to position 123*a* at full throttle thus to extend the air inlet to position D. The flow to the engine inlet manifold, shown at G, is via a port which is open between positions E and A. The distance between consecutive or adjacent vanes 21 thus defining the extent of chambers 70, illustrated diagrammatically by B to C and D to E in FIG. 3. The movement of the plate 123 can be controlled by mechanism 124 (for example a cable) in response to movement of an engine accelerator pedal 125 (FIG. 10).

Figure 12:
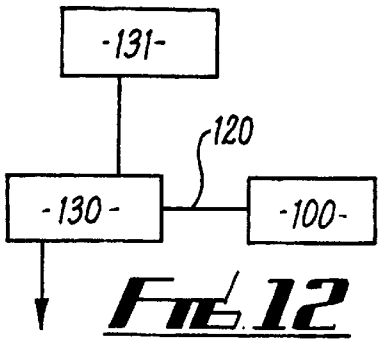
FIG. 12 is a flow diagram.

In a modification shown in FIG. 12, some of the exhaust gas passing through an exhaust pipe 130 from the internal combustion engine 131 is passed to the air inlet 120 of the rotary device 100 and is thus then fed back to the engine air inlet to reduce the nitric oxide content of the exhaust gas passing to atmosphere. The pressure of this exhaust gas is normally less than or equal to that of the ambient air.

Figure 13:
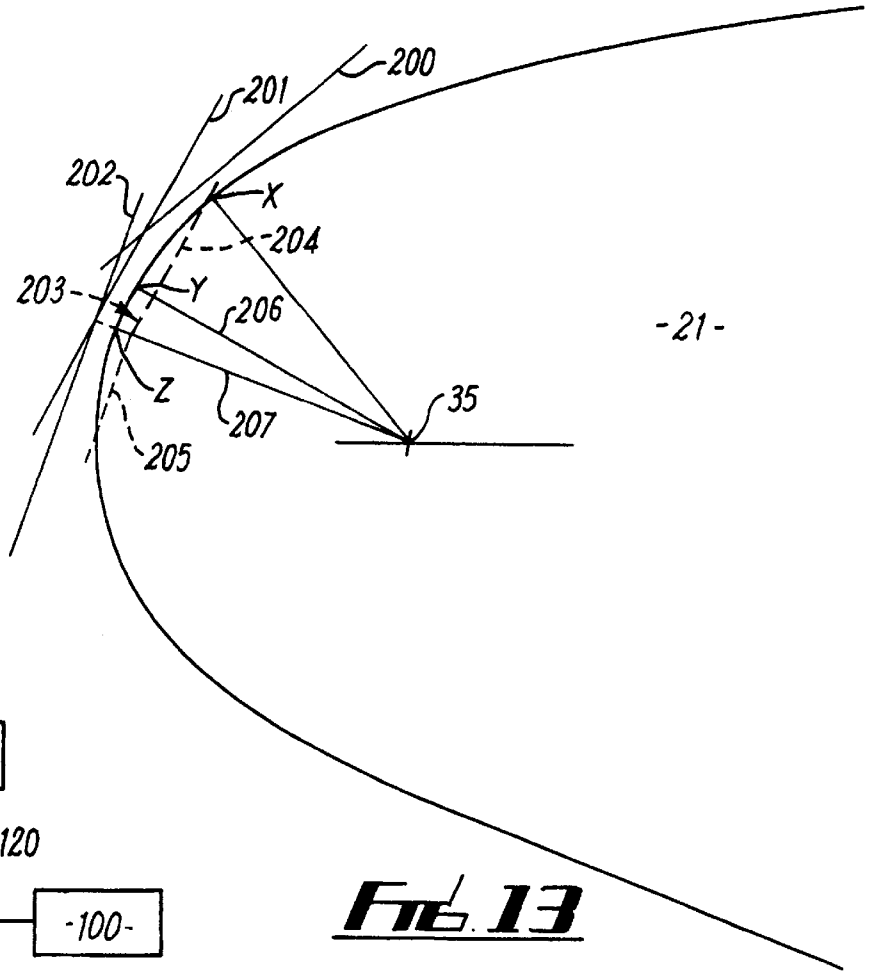
FIG. 13 is an enlarged view of part of a modified rotor vane.

FIG. 13 shows another arrangement intended for use at high speeds. Point X indicates the point of the tip which is closest to the casing when the vane is closed up (compartment at least volume); point Z indicates the point of the tip which is closest to the casing when the vane is fully open (compartment at maximum volume); and point Y is between points X and Z.

Lines 200, 201, 202 are tangents to the casing surface opposite points X, Y, Z respectively.

As the vane tip pivots during operation, the part of the vane tip closest to the internal surface of the casing moves from point X to point Z. Between point Y and Z the mechanism stresses are at their highest and the normal tip clearance (calculated at X) reduces. Typically the linkage mechanism between the vane and the drive shaft, which causes the vane to oscillate, stretches and/or twists (including bearings, crank arm) and the tip clearance is reduced. If the reduction is greater than the available clearance, this will produce tip-rub.

At high speeds e.g. 6000 rpm there is a relatively large tip movement between points Y and Z. To prevent a heavy rub on the tip, the tip profile is modified to a more flattened shape as shown by the broken line 203. This may follow the curvature of the casing at every increment, or for practical purposes, the line 203 could be two flats 204, 205 machined on the tip at right angles to the radii 206, 207 at points Y and Z respectively.

What is claimed is:

1. A rotary positive-displacement fluid machine comprising:

casing having an inner surface; and a rotor disposed within the casing and rotatable about a first axis, the rotor including:

a plurality of recesses;

a plurality of vanes, each one of the plurality of vanes being received in a corresponding one of the plurality of recesses, each one of the plurality of vanes oscillating about a corresponding second axis as the rotor rotates about the first axis, each corresponding second axis being located between the first axis and the inner surface of the casing, and each one of the plurality of vanes having a respective shaft extending along the respective second axis;

a plurality of cranks, each one of the plurality of cranks being operatively coupled to a corresponding one of the plurality of vanes;

a plurality of arms, each one of the plurality of arms being operatively coupled to a corresponding one of the plurality of cranks at a respective third axis, and each of the plurality of arms oscillating about a fourth axis that is offset from the first axis of the rotor; and first and second rotor end members supporting the plurality of vanes for oscillation about each respective second axis, the first rotor end member including a first part and a second part, the second part being positioned between the first part and the plurality of vanes, the first and second parts being adapted to be assembled by relative axial movement, and the first rotor end member including:

a bearing between the first part and the vane shaft; and a seal between the second part and the vane shaft.

2. A rotary positive-displacement fluid machine according to claim 1, wherein the first part is fastened to the second part.

3. A rotary positive-displacement fluid machine according to claim 2, wherein the first and second parts define a passage that allows fluid communication to each vane shaft.

4. A rotary positive-displacement fluid machine according to claim 1, wherein each one of the plurality of vanes comprises a tip including at least one arcuate segment with respect to a respective third axis.

5. A rotary positive-displacement fluid machine according to claim 4, wherein the tip further comprises at least one linear segment tangent to the respective third axis.

6. A rotary positive-displacement fluid machine comprising:

a casing having an inner surface, a fluid inlet port, and a fluid outlet port, a size of the fluid inlet port being automatically adjustable according to changes in fluid mass flow; and a rotor disposed within the casing and rotatable about a first axis, the rotor including:

a plurality of recesses;

a plurality of vanes, each one of the plurality of vanes being received in a corresponding one of the plurality of recesses, each one of the plurality of vanes oscillating about a corresponding second axis as the rotor rotates about the first axis, each corresponding second axis being located between the first axis and the inner surface of the casing, and each pair of adjacent ones of the plurality of vanes partially defining a respective chamber that serves repeatedly and alternately as a compression chamber and as an expansion chamber;

a plurality of cranks, each one of the plurality of cranks being operatively coupled to a corresponding one of the plurality of vanes; and a plurality of arms, each one of the plurality of arms being operatively coupled to a corresponding one of the plurality of cranks at a respective third axis, and each of the plurality of arms oscillating about a fourth axis that is offset from the first axis of the rotor.

7. A rotary positive-displacement fluid machine according to claim 6, wherein the rotor further comprises at least one rotor end member supporting the plurality of vanes for oscillation about each respective second axis, the at least one rotor end member including a first part and a second part, and the first and second parts being adapted to be assembled by relative axial movement.

8. A rotary positive-displacement fluid machine according to claim 7, wherein the first part is fastened to the second part.

9. A rotary positive-displacement fluid machine according to claim 7, wherein the first part is received within the second part.

10. A rotary positive-displacement fluid machine according to claim 6, wherein each one of the plurality of vanes comprises a tip including at least one arcuate segment with respect to a respective third axis.

11. A rotary positive-displacement fluid machine according to claim 10, wherein the tip further comprises at least one linear segment tangent to the respective third axis.

12. A rotary positive-displacement fluid machine comprising:

a casing having an inner surface; and a rotor disposed within the casing and rotatable about a first axis, the rotor including:

a plurality of recesses;

a plurality of vanes, each one of the plurality of vanes being received in a corresponding one of the plurality of recesses, each one of the plurality of vanes oscillating about a corresponding second axis as the rotor rotates about the first axis, each corresponding second axis being located between the first axis and the inner surface of the casing, and each one of the plurality of vanes having a curved vane tip including a more flattened shape to ensure clearance from the casing at high rotor speeds;

a plurality of cranks, each one of the plurality of cranks being operatively coupled to a corresponding one of the plurality of vanes; and a plurality of arms, each one of the plurality of arms being operatively coupled to a corresponding one of the plurality of cranks at a respective third axis, and each of the plurality of arms oscillating about a fourth axis that is offset from the first axis of the rotor.

13. A rotary positive-displacement fluid machine according to claim 12, wherein the flattened section comprises one or more flats.

14. A rotary positive-displacement fluid machine according to claim 12, wherein the rotor further comprises at least one rotor end member supporting the plurality of vanes for oscillation about each respective second axis, the at least one rotor end member including a first part and a second part, and the first and second parts being adapted to be assembled by relative axial movement.

* * * * *